United States Patent [19]

Willingham

[11] Patent Number: 4,487,325

[45] Date of Patent: Dec. 11, 1984

[54] CROWN CLOSURES AND CONTAINERS

[75] Inventor: Wendell D. Willingham, Milwaukee, Wis.

[73] Assignee: Owens-Illinois, Inc., Toledo, Ohio

[21] Appl. No.: 395,396

[22] Filed: Jul. 6, 1982

[51] Int. Cl.[3] ..... A61B 10/00

[52] U.S. Cl. ..... 215/307; 215/341; 215/350; 215/351

[58] Field of Search ..... 215/252, 307, 318, 341, 215/346, 349, 350, 351

[56] References Cited

U.S. PATENT DOCUMENTS

| | | | |
|---|---|---|---|
| 2,026,889 | 1/1936 | Gray et al. | 215/351 |
| 2,136,545 | 11/1938 | Gibbs | 215/346 |
| 2,982,433 | 5/1961 | Chaplin | 215/346 |
| 3,057,501 | 10/1962 | Kroenert | 215/349 |
| 3,559,833 | 2/1971 | Alonso | 215/349 |
| 3,741,423 | 6/1973 | Acton et al. | 215/346 |
| 3,924,772 | 12/1975 | Magnani | 215/352 |
| 3,976,217 | 8/1976 | Dukess | 215/348 |
| 3,979,004 | 9/1976 | Bertario | 215/341 |
| 4,076,152 | 2/1978 | Mumford | 215/350 |
| 4,192,428 | 3/1980 | Segmuller | 215/307 |
| 4,204,606 | 5/1980 | Micheli | 215/307 |
| 4,261,475 | 4/1981 | Babiol | 215/341 |
| 4,280,631 | 7/1981 | Lohrman | 215/350 |
| 4,347,939 | 9/1982 | Upton | 215/341 |
| 4,369,889 | 1/1983 | Ostrowsky | 215/307 |

FOREIGN PATENT DOCUMENTS

| | | | |
|---|---|---|---|
| 459783 | 9/1949 | Canada | 215/350 |

*Primary Examiner*—Joseph Man-Fu Moy
*Assistant Examiner*—David Fidei
*Attorney, Agent, or Firm*—John R. Nelson; Myron E. Click

[57] ABSTRACT

A crown closure and container comprising a glass container having a crown finish without threads, a closure comprising a rigid plastic outer shell and an inner cup-shaped liner. The outer shell comprises a top panel and a peripheral skirt. The liner is made of soft resilient plastic material and comprises a top wall and a peripheral wall. Interengaging cam surfaces are provided between the inner surface of the skirt of the shell and the outer surface of the peripheral wall of the liner such that when the closure is applied to the crown finish by an axial motion of the closure relative to the container, the liner if forced into the shell and the upper portion of the liner engages the crown finish of the container. The peripheral skirt of the outer shell is formed with threads so that the upper portion of the liner is forced into the threads and will allow for sufficient interference with the liner and finish to permit removal of the closure by rotation of the shell in relation to the liner.

8 Claims, 11 Drawing Figures

CROWN CLOSURES AND CONTAINERS

This invention relates to crown closures and containers.

BACKGROUND AND SUMMARY OF THE INVENTION

In the packaging of liquids and carbonated beverages, a commonly used closure and container arrangement is one wherein the container has a crown finish, that is, an annular bead at the upper end thereof. The closures commonly comprise metal caps that are crimped onto the crown finish. More recently, it has been common to provide fine threads on the crown finish which perform the function of permitting the closure to be removed by a twisting action so that the threads provide an axial movement of the closure relative to the container. Where the container is made of glass or plastic, it has been found that the percentage of off ware or containers that cannot be used is rather high. Accordingly, it would be desirable to have a twist-off feature in a closure which does not require the formation of threads on the container. Further, the crimping of the cap requires more complex equipment and it would be desirable to provide a cap that does not require crimping.

Insofar as the applicant is aware, it has not been possible to provide a pilferproof band on crown closures which would indicate that the contents have been tampered with or the seal had been broken.

Accordingly, among the objectives of the present invention are to provide a crown closure and container wherein crimping is not required to apply the closure; wherein it is not necessary that the threads be formed on the container to define or provide a twist-off feature; which provides for venting of the contents where the contents are under pressure; and wherein a pilferproof band is provided.

In accordance with the invention, the crown closure and container comprises a glass container having a crown finish without threads, a closure comprising a rigid plastic outer shell and inner cup-shaped liner. The outer shell comprises a top panel and a peripheral skirt. The liner is made of soft resilient plastic material and comprises a top wall and a peripheral wall. Interengaging cam means are provided between the inner surface of the skirt of the shell and the outer surface of the peripheral wall of the liner such that when the closure is applied to the crown finish by an axial motion of the closure relative to the container, the liner is forced into the shell and the upper portion of the liner engages the crown finish of the container. The peripheral skirt of the outer shell is formed with threads so that the upper portion of the liner is forced into the threads and will allow for sufficient interference with the liner and finish to permit removal of the closure by rotation of the shell in relation to the liner.

DESCRIPTION

Figure 1:
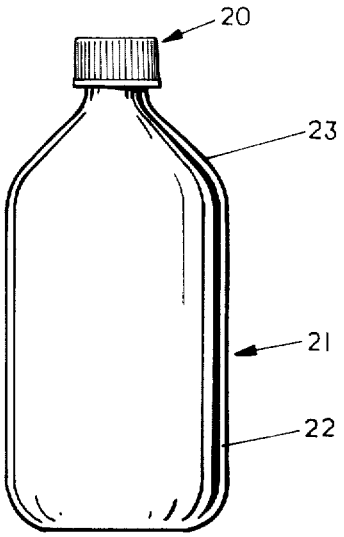
FIG. 1 is an elevational view of a closure and container embodying the invention.
Figure 2:
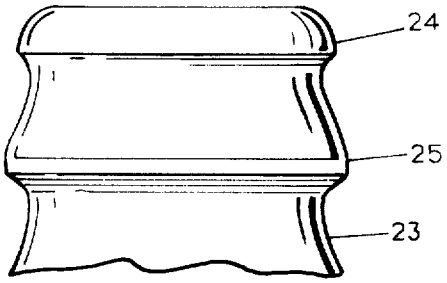
FIG. 2 is a fragmentary elevational view of the container.

Referring to FIG. 1, the combined crown closure and container comprises a closure 20 and a container 21. The container 21 is preferably made of glass and includes a body 22, a neck 23, a crown finish 24 of conventional design, and a transfer bead 25 below the crown that is normally used to handle the container during maintenance (FIG. 2).

Figure 8:
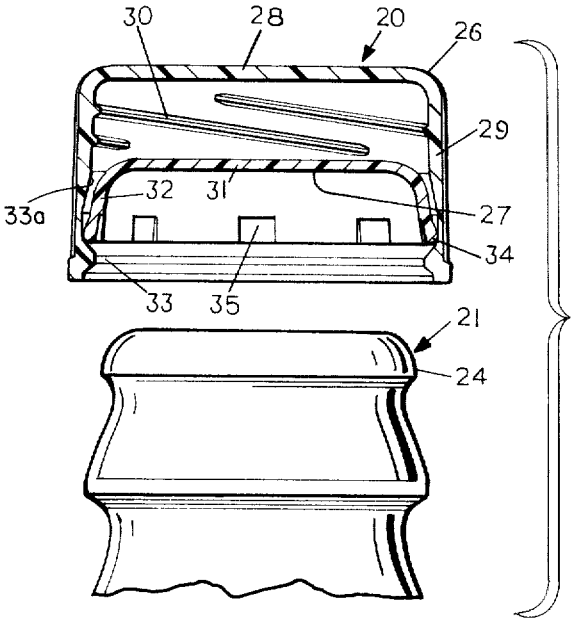
FIG. 8 is a fragmentary exploded view of the closure and container prior to assembly.

As shown in FIG. 8, the closure 20 comprises an outer shell 26 of rigid plastic material and an inner liner 27 of soft resilient material. A suitable rigid plastic for the shell 26 comprises polypropylene and a suitable plastic for the liner 27 comprises low density polyethylene.

Figure 3:
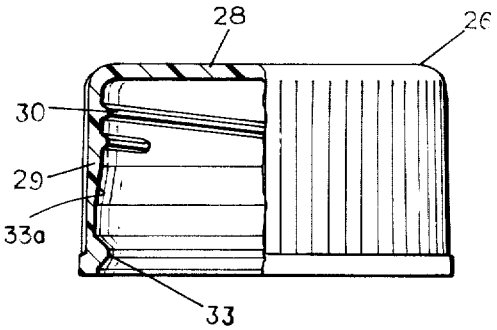
FIG. 3 is a part sectional elevational view of the shell of the closure.
Figure 4:
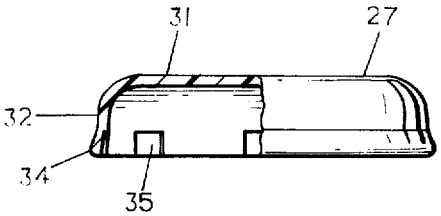
FIG. 4 is a part sectional elevational view of the liner of the closure.

The outer shell 26 includes a top panel 28 and a peripheral skirt 29. The inner surface of the upper portion of skirt 29 is formed with threads 30 having a substantial pitch (FIG. 3). The liner 27 includes a top wall 31 and a peripheral wall 32 (FIG. 4). The length of the skirt 29 of the shell 26 is greater than the length of the peripheral wall 32 of the liner 27. Prior to application to the container, the liner is assembled in the shell in the position shown in FIG. 8.

Figure 6:
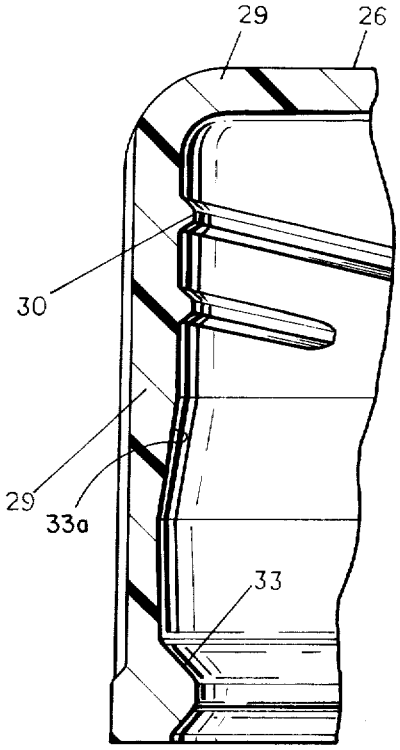
FIG. 6 is a fragmentary view similar to FIG. 3 on an enlarged scale.

The shell 26 and liner 27 include interengaging cam means that function to force the liner 27 against the crown, as presently described. This means comprises a frustoconical cam surface **33*a* on the inner surface of the skirt of the shell that tapers upwardly and inwardly (FIG. 6) and an annular arcuate cross section bead 34 on the lower end of the peripheral wall 32 of the liner 27** (FIG. 7).

Referring to FIG. 8, the closure 20 is applied by an axial movement moving the closure 20 so that the liner 27 is forced upwardly bringing the top panel 28 of the shell 26 into engagement with the top wall 31 of the liner 27. During this movement, the peripheral wall 32 of the liner is caused to provide sealing engagement with the periphery of the crown. The liner 27 is of sufficiently soft material that it fills any irregularities in the crown finish or surface. In addition, the annular bead 34 on the liner 27 is cammed against and locked under the crown finish by the cam surface 33 on the shell 26.

Figure 5:
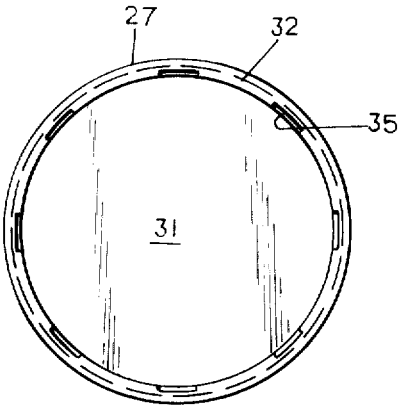
FIG. 5 is a bottom plan view of the liner.
Figure 7:
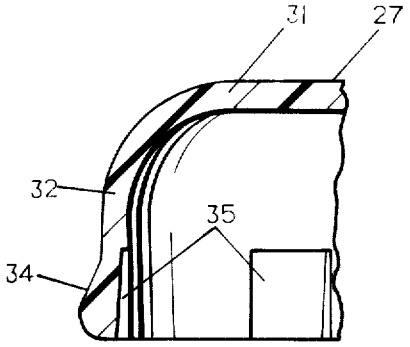
FIG. 7 is a fragmentary view similar to FIG. 4 on an enlarged scale.
Figure 9:
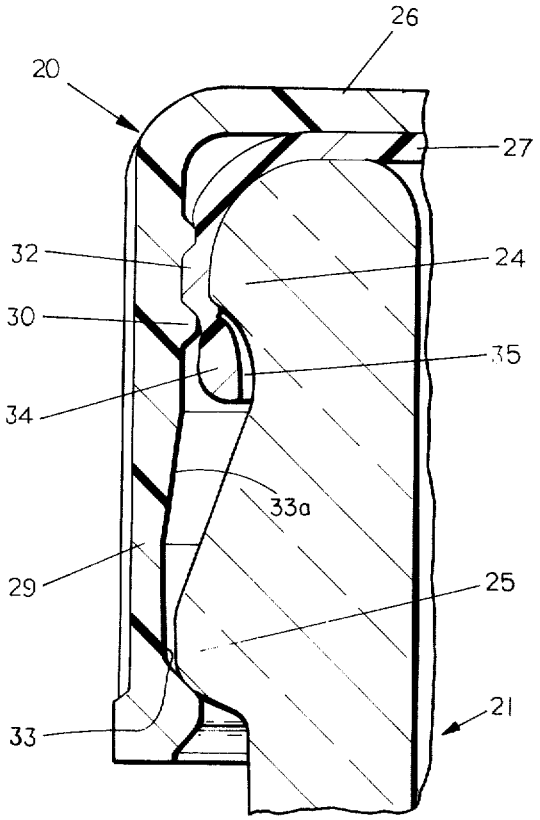
FIG. 9 is a fragmentary sectional view of the assembled closure and container.

In addition, during this axial movement, the threads 30 on the skirt of the shell are caused to deform into the wall 32 of the liner 27 (FIG. 9). This is sufficient so that upon twisting of the shell 26, the interference fit between the liner 27 and the crown bead 24 causes the shell 26 to move axially outwardly relative to the liner 27 and is readily removed. As the shell 26 moves up and away from the crown bead 24 (FIG. 9), the relieved contour on the skirt 29 of the shell 26 provided by cam surface **33*a* below threads 30 thereon permits relaxing of the interference fit between the skirt 29 and the liner 27. Continual axial upward movement of the shell 26** may cause cam surface or bead 33 on shell 26 to engage liner 27.

Where the closure is to be utilized with pressurized contents such as carbonated beverages or with contents under vacuum, vents 35 are provided in the liner and comprise slots extending from the lower edge of the inner surface of the peripheral wall of the liner upwardly toward the top wall of the liner upwardly toward the top wall (FIGS. 4, 5, 7). As the shell moves up and away from the crown bead 24 and the interference fit between the skirt 29 and liner is relaxed, the contents, if pressurized or packed under vacuum, may vent at slots 35 as the liner 27 relaxes from its fit on crown bead 24.

Figure 10:
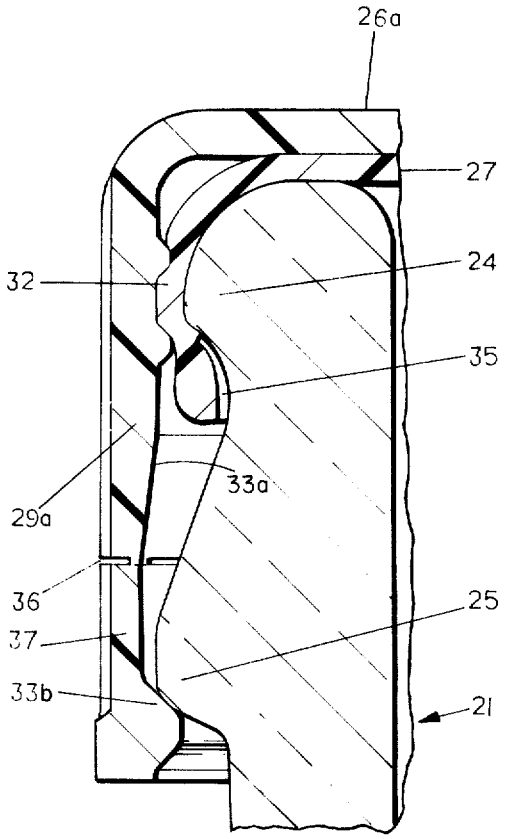
FIG. 10 is a fragmentary sectional view of a modified form of closure and container.

In the form shown in FIG. 10, the shell **26*a* preferably includes a score or weakened line 36 that forms the lower portion of skirt 29*a* to define a pilferproof band 37 that is connected to the remainder of the skirt by the score or weakened line 36. The band 37 includes an annular radially extending bead 33*b* that snaps below the transfer bead on the container in the same manner as described for the embodiments of FIGS. 9 and 11. The lower surface of the transfer bead 25 of the container may in some instances need to be modified to provide a sufficient shoulder for holding the band. As the closure is removed, the band 37 is at least partially severed from the closure in a manner well known in the art of other types of closures to indicate that the seal has been broken and the contents may have been tampered with. If the band 37** is completely severed, it remains on the container.

Figure 11:
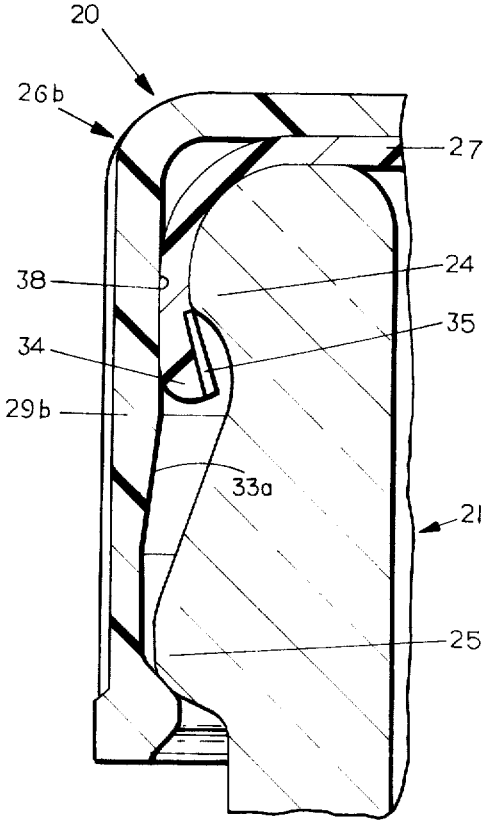
FIG. 11 is a fragmentary sectional view of another modified form of closure and container.

In the form shown in FIG. 11, the threads are omitted and the inner surface of the upper portion of skirt **29*b* or the shell 26*b* is smooth as at 38**. The closure is applied by axial movement and removed by prying off in the manner of a conventional crown finish.

I claim:

1. A crown closure and container comprising a glass container having a crown finish without threads and having an annular transfer bead spaced axially from the finish, a closure comprising an outer shell and a separate inner cup-shaped liner, said outer shell being made of rigid plastic and comprising a top panel, a peripheral skirt and a radially inwardly extending bead on the free edge of the skirt, said liner being made of soft resilient plastic material and comprising a top wall, a peripheral wall and a radially outwardly extending bead on the free edge of the outer surface of the peripheral wall of the liner, the axial extent of said peripheral skirt of said outer shell being greater than the axial extent of said peripheral wall of said liner such that the liner may be moved axially within the shell when the closure is not in position on the container, said liner being initially positioned within said shell with said bead on said shell engaging the bottom of the bead on the free edge of the peripheral wall of the liner to retain said liner within said shell, said closure being adapted to be applied to a container with the bead on the shell removably retaining the closure on the transfer bead, an annular frustoconical cam surface on the inner surface of the skirt of the shell spaced from the top panel of said shell adapted to engage the radially outwardly extending bead on the free edge of the outer surface of the peripheral wall of the liner when the liner is moved axially into the shell such that when the closure is applied to the crown finish by an axial motion of the closure relative to the container, the cam surface engages the bead on the liner and the liner is forced axially into the shell, the peripheral wall of said liner is moved by the cam surface into sealing engagement with the inner surface of the upper portion of the peripheral skirt of the outer shell and the periphery of the crown finish and the free edge of the liner is moved radially inwardly by the cam surface against and locked under the crown finish on the container and the top wall of the liner engages the top of the crown finish of the container, said skirt of said shell having threads on the upper end of the inner surface thereof between the cam surface and the top panel such that when the closure is applied to the container, the threads are forced into the upper portion of the peripheral wall of the liner so that when the shell is thereafter rotated in a direction to unthread the shell from the liner, the threads will form an interference fit between the liner and the crown finish to provide an axial force when the shell is rotated causing the shell to move axially relative to the liner and crown finish to move the cam surface on the skirt of said shell axially away from the peripheral wall of said liner so that the skirt of the liner will no longer be retained under the crown finish of the container permitting the closure to be disengaged and removed from the container.

2. The crown closure and container set forth in claim 1 wherein said liner has vent openings in the peripheral wall thereof to provide for venting of the contents of the container as the closure is being removed.

3. The crown closure and container set forth in claim 2 wherein said vent means comprises circumferentially spaced slots in the peripheral wall extending axially from the lower edge thereof toward the top wall.

4. The crown closure and container set forth in claim 1 including an integral pilferproof band on the skirt of the shell, means defining a weak line of severance between the band and the remainder of the skirt, said band having said radially inwardly extending bead for engagement with the bead on the container such that when the closure is removed, the pilfer band is at least partially severed from the remainder of the shell to indicate that the seal of the closure with the container has been broken.

5. A crown closure for a container having a crown finish without threads and an annular transfer bead spaced axially from the finish comprising an outer shell and a separate inner cup-shaped liner, said outer shell being made of rigid plastic and comprising a top panel, a peripheral skirt and a radially inwardly extending bead on the free edge of the skirt, said liner being made of soft resilient plastic material and comprising a top wall, a peripheral wall and a radially outwardly extending bead on the free edge of the outer surface of the peripheral wall of the liner, the axial extent of said peripheral skirt of said outer shell being greater than the axial extent of said peripheral wall of said liner such that the liner may be moved axially within the shell when the closure is not in position on the container, said liner being initially positioned within said shell with said bead on said shell engaging the bottom of the bead on the free edge of the peripheral wall of the liner to retain said liner within said shell, said closure being adapted to be applied to a container with the bead on the shell removably retaining the closure on the transfer bead, an annular frustoconical cam surface on the inner surface of the skirt of the shell spaced from the top panel of said shell adapted to engage the radially outwardly extending bead on the free edge of the outer surface of the peripheral wall of the liner when the liner is moved axially into the shell such that when the closure is applied to the crown finish by an axial motion of the closure relative to the container, the cam surface engages the bead on the liner and the liner is forced axially into the shell, the peripheral wall of said liner is moved by the cam surface into sealing engagement with the inner surface of the upper portion of the peripheral skirt of the outer shell and the periphery of the crown finish and the free edge of the liner is moved radially inwardly by the cam surface against and locked under the crown finish on the container and the top wall of the liner engages the top of the crown finish of the container, said skirt of said shell having threads on the upper end of the inner surface thereof between the cam surface and the top panel such that when the closure is applied to the container, the threads are forced into the upper portion of the peripheral wall of the liner so that when the shell is thereafter rotated in a direction to unthread the shell from the liner, the threads will form an interference fit between the liner and the crown finish to provide an axial force when the shell is rotated causing the shell to move axially relative to the liner and crown finish to move the cam surface on the skirt of said shell axially away from the peripheral skirt of said liner so that the skirt of the liner will no longer be retained under the crown finish of the container permitting the closure to be disengaged and removed from the container.

6. The crown closure set forth in claim 5 wherein said liner has vent openings in the peripheral wall thereof to provide for venting of the contents of the container as the closure is being removed.

7. The crown closure set forth in claim 6 wherein said vent means comprises circumferentially spaced slots in the peripheral wall extending axially from the lower edge thereof toward the top wall.

8. The crown closure set forth in claim 5 including an integral pilferproof band on the skirt of the shell, means defining a weak line of severance between the band and the remainder of the skirt, said band having said radially inwardly extending bead for engaging with a bead on the container such that when the closure is removed, the pilfer band is at least partially severed from the remainder of the shell to indicate that the seal of the closure with the container has been broken.

* * * * *